US005769231A

United States Patent [19]

Batsford

[11] Patent Number: 5,769,231

[45] **Date of Patent: *Jun. 23, 1998**

[54] AIR INFLATABLE AND DEFLATABLE END CAP PACKAGING COMPONENTS

[75] Inventor: Charles A. Batsford, Stow, Mass.

[73] Assignee: Air-Ride Packaging of America, Inc., Stow, Mass.

[ * ] Notice: The term of this patent shall not extend beyond the expiration date of Pat. No. 5,351,829.

[21] Appl. No.: 639,937

[22] Filed: Apr. 19, 1996

Related U.S. Application Data

[63] Continuation of Ser. No. 274,225, Jul. 13, 1994, abandoned.

[51] Int. Cl.[6] ..... B65D 81/03

[52] U.S. Cl. ..... 206/522

[58] Field of Search ..... 206/521–524, 206/591–594, 320

[56] References Cited

U.S. PATENT DOCUMENTS

| | | | |
|---|---|---|---|
| 3,398,501 | 8/1968 | Aninger | 206/522 |
| 3,552,466 | 1/1971 | Fairchilds | 206/522 |
| 3,889,743 | 6/1975 | Presnick | 206/522 |
| 4,044,867 | 8/1977 | Fisher | 206/522 |
| 4,091,852 | 5/1978 | Jordon et al. | 206/522 |
| 4,905,835 | 3/1990 | Pilvert et al. | 206/522 |
| 5,009,318 | 4/1991 | Lepinoy | 206/524.8 |
| 5,180,060 | 1/1993 | Forti et al. | 206/522 |
| 5,263,587 | 11/1993 | Elkin et al. | 206/522 |
| 5,340,632 | 8/1994 | Chappois . | |
| 5,348,157 | 9/1994 | Pozzo | 206/522 |
| 5,351,829 | 10/1994 | Batsford | 206/522 |

FOREIGN PATENT DOCUMENTS

| | | | |
|---|---|---|---|
| 1-308775 | 12/1989 | Japan | 206/522 |
| 848248 | 9/1960 | United Kingdom | 206/522 |
| 2258446 | 2/1993 | United Kingdom | 206/522 |

*Primary Examiner*—Jimmy G. Foster
*Attorney, Agent, or Firm*—Ernest V. Linek

[57] ABSTRACT

An end cap packaging component having a first pair of generally rectangular elements appropriately disposed at two sides thereof and a second pair of generally rectangular elements appropriately disposed at the remaining two sides thereof. The first and second pairs of elements are interconnected at their peripheries to form an interior element directly coupled to the first and second pairs of elements. All of such elements are inflatable and deflatable using an appropriately postioned valve. Each of the elements has one or more non-inflatable regions therein and further non-inflatable regions are located where the interior element is coupled to the first and second pairs of elements. When inflated, the component can be folded to form an end cap shaped configuration which encloses the end portion of a product for providing a firm and snug fit thereon which then acts as a retaining cushion therefor the product is then placed in a shipping container.

3 Claims, 2 Drawing Sheets

AIR INFLATABLE AND DEFLATABLE END CAP PACKAGING COMPONENTS

This application is a continuation of application Ser. No. 08/274,225 filed on Jul. 13, 1994, abandoned.

INTRODUCTION

This invention relates generally to product packaging techniques and, more particularly, to uniquely configured inflatable packaging components which provide effective and reliable retention and protection of products during shipment, which components are both reusable and recyclable.

BACKGROUND OF THE INVENTION

Many products when being transported in shipping containers must be firmly retained in such containers under often severe handling conditions, i.e., when the containers are subject to vibration, dropping, or other relatively violent movements thereof, so as to prevent damage of the product. Current packaging techniques for such purposes conventionally include the use of solid plastic foam blocks, e.g., of polystyrene or other thermosetting plastic materials, which are specifically shaped to conform to an overall product or at least to selected portions of the product and act as substantially inflexible retainers which relatively completely, or at least partially, surround the product within a shipping container. In some cases, gaps between the product and the container are often loosely filled with separately formed polystyrene plastic pellets, sometimes referred to in the packaging field as plastic "peanuts" or "void fill", or the product may be completely immersed in such pellets within a container.

Such techniques are relatively expensive in that the components used therein are generally discarded once shipment has been made and the product has been removed from the container since such components are not readily reusable and generally cannot be readily recycled. Accordingly, they are often merely placed in landfills where they can be environmentally harmful since they do not degrade as would be desired.

While it has been suggested that simple rectangular plastic bags, i.e., polyethylene plastic bags inflated with air and permanently sealed, be merely placed at various positions adjacent a product in its container so as to provide a cushion therefor, such inflated polyethylene bags are not effective in retaining the product in a reasonably fixed position in the container and also tend to lose the air therein relatively rapidly so as to become unusable, either during or after transit, and are not readily recyclable. Moreover, such materials are not static dissipative materials, a characteristic which is often desirable in packaging many products, such as electronic products, for example. Further, such inflated bags are relatively easily punctured and often cannot withstand the rough handling which may occur during shipment.

Another approach that has been suggested is depicted in my U.S. application Ser. No. 08/153,485, filed Nov. 16, 1993 and now U.S. Pat. No. 5,351,829, which is a continuation of Ser. No. 08/002,066, filed Jan. 8, 1993, now abandoned. As discussed therein, an air inflatable and deflatable packaging component has a configuration which comprises a generally rectangularly shaped portion coupled to a generally oval, or elliptically, shaped portion, the overall component, when inflated, being foldable in a manner so as to form a uniquely shaped inflated cushion element which can be placed, for example, at a corner of a product so as to provide a firm and snug fit thereon. A plurality of such components, which are coupled to each other via a common coupling channel, are used at each corner of a product within a shipping container or carton so as to provide an effective technique for firmly and safely retaining the product within the shipping container so that the product can stand relatively violent handling thereof during shipment. While such configuration is useful in many applications, it may be less effective for certain product shapes. Hence, it is desirable to devise an alternative packaging configuration for use in some applications, as described more fully below.

BRIEF SUMMARY OF THE INVENTION

In accordance with the invention, a packaging component is formed as an air inflatable and deflatable end cap component having a configuration which is uniquely predetermined and is foldable so as to provide a unique shape which fits the shape of an end of a product with which it is to be used. A pair of such components can be used at opposite ends, respectively, of the product and are easily and readily inflated, with an air pump, or readily deflated, by using an appropriate device, such as a valve, for such purposes. The components are made of a thermoplastic, polyurethane material which can retain its inflated state for an extended period of time and which can be reused many times and which, when the useful lives of the components are over, need not be discarded but can be recycled so that such components can be refabricated. Moreover, such materials can be made static dissipative in nature for use in many applications requiring such characteristics.

DESCRIPTION OF THE INVENTION

The invention can be better understood with the help of the accompanying drawings wherein FIG. 1 shows a plan view of a preferred embodiment of a non-inflated packaging component in accordance with the invention;

Figure 1:
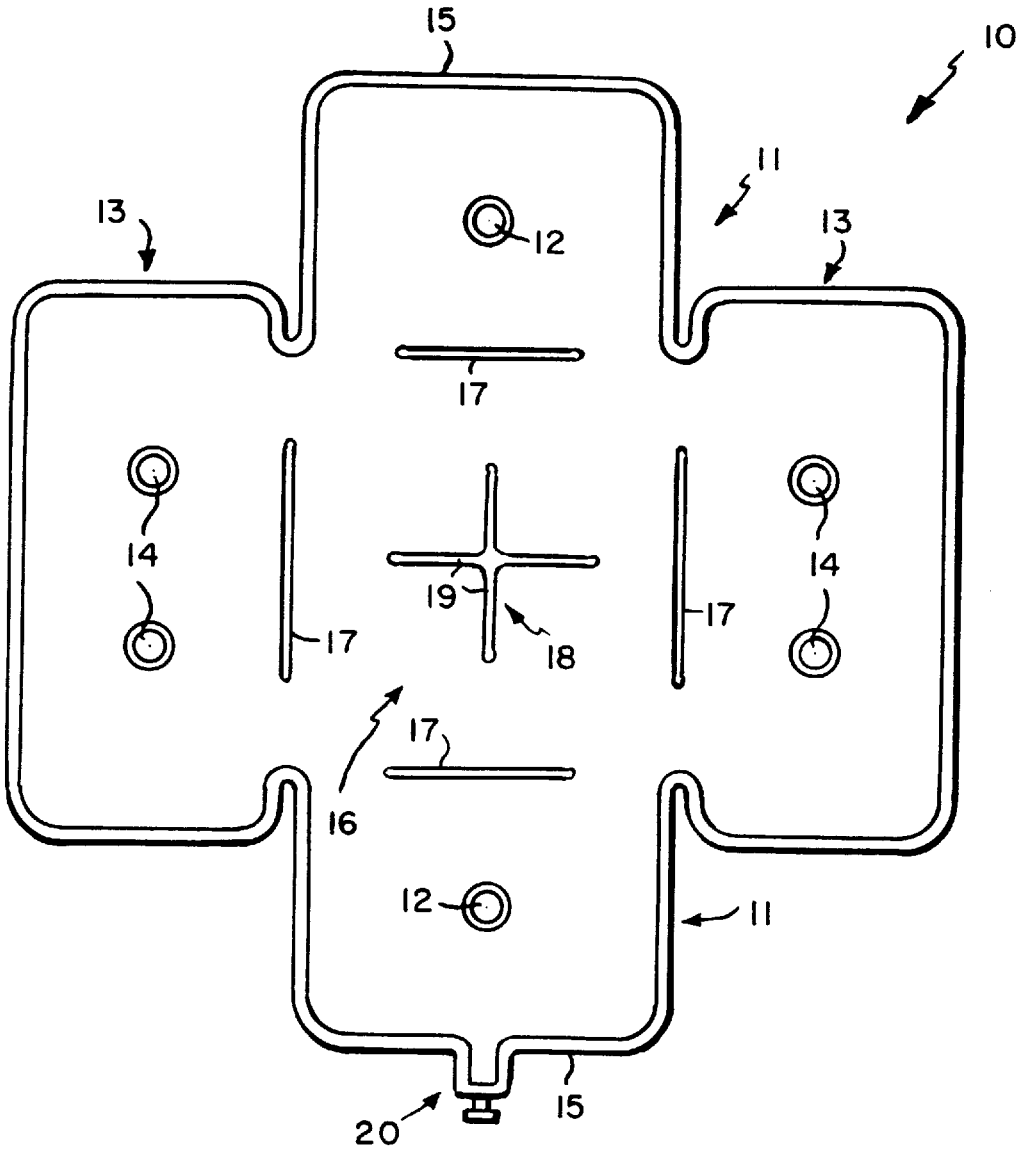
Figure 2:
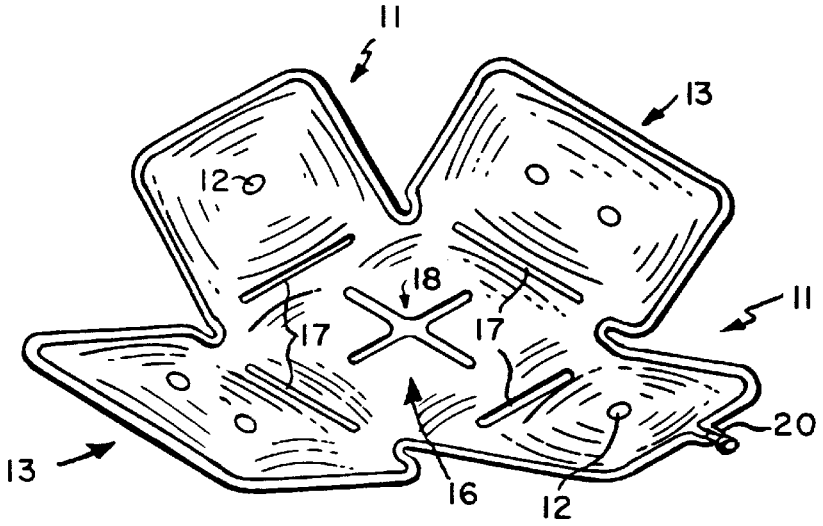
FIG. 2 shows a perspective view of the embodiment of FIG. 1, when inflated.
Figure 3:
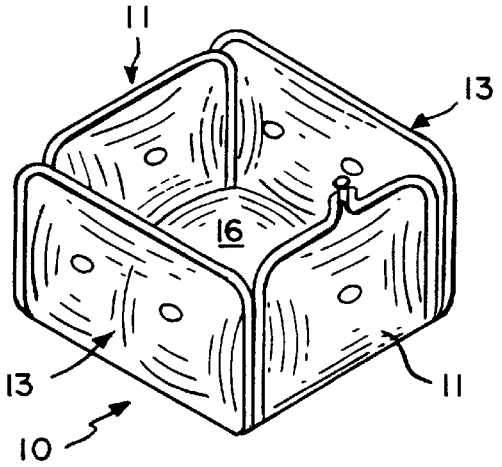
FIG. 3 shows a perspective view of the embodiment of FIG. 2, folded in a desired end cap configuration.
Figure 4:
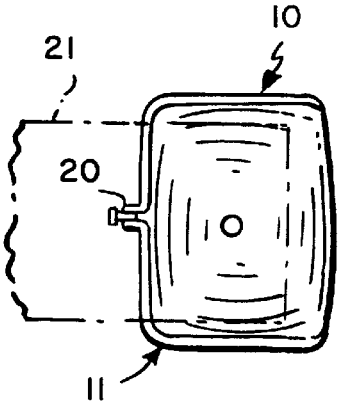
FIG. 4 shows a side view of the embodiment of FIG. 3 when placed on an end of a product.

As can be seen in FIG. 1, a plan view of a basic packaging component 10 in its non-inflated form, in accordance with a preferred embodiment of the invention, is configured so as to comprise a first pair of generally rectangular inflatable elements 11, oppositely disposed at two sides of component 10, each of which elements includes at least one non-inflatable region 12 preferably generally centrally located therein. In the embodiment depicted, a single, circular non-inflatable region is shown, although the region may have other shapes, e.g., rectangular, oval, bar shaped, cross-shaped, etc., or may comprise a plurality of relatively smaller such regions generally centrally located in elements 11. A second pair of inflatable, generally rectangular elements 13 are interconnected at their peripheries with elements 11 and are oppositely disposed at the remaining two sides of component 10 and each has at least one non-inflatable region 14 therein. In the particular embodiment depicted, a pair of circular non-inflatable regions are used in elements 13 as shown. Other shapes of one or more non-inflatable regions can be used, as discussed above. The peripheries of elements 11 and 12 are hermatically sealed at region 15 so that the entire periphery of componant 10 is so sealed.

The interconnected elements 11 and 12 are so arranged that they further form an interior, generally rectangular inflatable region 16 the sides of which are directly coupled to the interior sides of elements 11 and 13, there being an extended non-inflatable region 17 along each side thereof where such coupling occurs. Further, a generally centrally located non-inflatable region 18 is formed in region 16, as depicted in the specific embodiment shown by a cross-shaped region formed by non-inflatable crossed arms 19. Other configurations can be used to form the non-inflated region 18, including the use of a plurality of separately formed regions, e.g., circular, square, oval, elongated regions, etc. The non-inflatable regions prevent each of the elements from "ballooning" when inflated so that they generally retain their desired general shape upon inflation and so that they can be more readily folded to conform to the shape of an end portion of a product with which they are used.

The component shown in the preferred embodiment of FIG. 1 can be inflated using a suitable valve assembly appropriately located for easy access as, for example, at a peripheral location of the component, as shown by valve assembly 20 positioned at the periphery of upper element 11 in the figure. Such valve can be of any suitable type, e.g., such as the flutter valve assembly, discussed in my aforementioned application, as made and sold by Gregory Manufacturing Co. of Holyoke, Mass., or by others.

The elements of packaging component 10 are formed of an upper and lower layer of suitably selected plastic material which layers are sealed together, as by using radio frequency (R-F) or heat sealing techniques, for example, at the periphery thereof and at each of the non-inflatable regions thereof. The valve assembly 20 can be connected to a suitable external air pump (not shown) so that when the valve is opened, air is supplied between the upper and lower layers so as to inflate the inflatable elements of the component.

Figure 5:
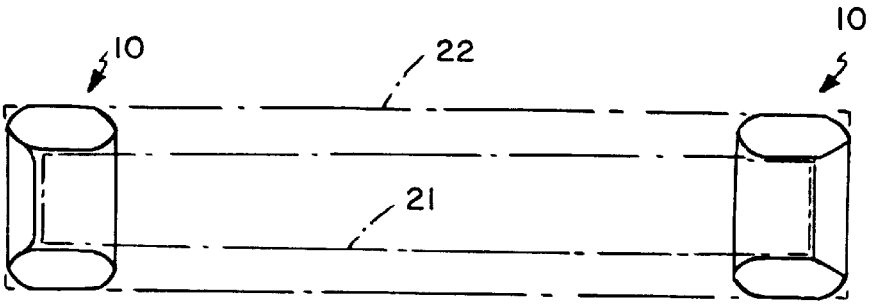
FIG. 5 shows a diagrammatic side view in section of a pair of inflated and folded packaging components of the type shown in FIGS. 1–4 when used with a product and placed in a container.

When the component is suitably inflated, the valve is then closed, the pump is disconnected therefrom, and the valve is suitably plugged so that the inflated elements are then appropriately sealed and formed for use. The inflated component can then be manipulated into a desired folded shape, as shown by the perspective views thereof in FIGS. 2, 3, and 4, respectively. When so folded, the component firmly fits around an end portion of a product 21, as shown in phantom in FIG. 4, so that component 10 acts as an end cap to cushion and retain the end portion thereof when the product and the component are placed within a shipping container. The elongated non-inflatable regions 17 generally form regions at which the folds can be readily made so that the inflated interior region 15 can generally be made to fit firmly over the end face of the product. The component 10 shown in FIGS. 1–4 represents a basic end cap component configuration, a pair of which can be utilized in combination at each end of a product to form an overall packaging system for a product. FIG. 5 shows a diagrammatic side view in section showing a pair of packaging components 10 used with for a product 21.

The plastic material used for the layers of such component can be specially selected to provide a relatively strong, as well as reusable and recyclable, element. The component can further be formed so as to be capable of having effective static dissipative characteristics, if desired, using techniques that are well known to those in the art. In a preferred embodiment of the invention, each layer of such component is in the form of a laminated layer of thermoplastic, polyurethane polymer plastic material. The laminate is preferably formed from two sheets, or films, of thermoplastic, polyurethane material such as made and sold by Deerfield Urethane, Inc., of South Deerfield, Mass. under the designation PS8020F, and by others. The polyurethane sheets are then laminated together by a suitable heat lamination process, a laminated layer of such type being available, for example, from Mann Industries of Framingham, Mass. under the designations PS8010F, and from others.

It has been found that such a two-sheet laminate is effective for use with products weighing up to fifty pounds or so, for example. For heavier products, it may be desirable to utilize a laminate comprising two sheets of thermoplastic, polyurethane material having an intermediate sheet of a closely woven, nylon mesh positioned therebetween to form a three-sheet, heat sealed laminate.

In a typical embodiment, for example, polyurethane films each having a thickness of 0.003 mil are used to form an overall laminate of 00.6 mil, while a third sheet of nylon mesh, if used, has a thickness of 0.001 mil to form an overall laminate of 0.007 mil. It is generally found that sheets of polyurethane film have a thickness between about 0.003 mil through 00.7 mil.

The relative sizes and shapes of the generally rectangular elements of a basic exemplary component configuration 10 can be appropriately selected depending on the dimensions of the ends of a particular product being packaged.

While the above-embodiment represents a preferred exemplary embodiment of the invention, modification thereto may occur to those in the art within the spirit and scope of the invention. Hence, the invention is not to be construed as limited to the particular embodiments described above except as defined by the appended claims.

What is claimed is:

1. A packaging component comprising a first pair of generally rectangular elements oppositely disposed at two sides of said component, and formed as inflatable and deflatable plastic elements;

a second pair of generally rectangular elements oppositely disposed at the remaining two sides of said component and formed as inflatable and deflatable plastic elements;

said first and second pairs of elements being interconnected at their peripheries to form a generally rectangular interior element of said component, said interior element being formed as an inflatable and deflatable plastic element directly coupled to each of said first and second pairs of elements, each of said first and second pairs of elements and said interior element having non-inflatable regions therein; and valve means for permitting air under pressure to be supplied to, or to be released from, said first and second pairs of elements and said interior element whereby said elements are inflated, or deflated, respectively;

said first and second pairs of elements being independently foldable when inflated, thereby providing a conformational cushioning effect;

wherein said first and second pairs of elements and said interior element are formed of layers of laminated polyurethane film material sealed about the peripheries of said first and second pairs elements and sealed at said non-inflatable regions; and wherein said laminated film material includes a pair of thermoplastic, polyurethane sheets having an intermediate sheet of nylon mesh material therebetween, all of said sheets being laminated together.

2. A packaging component in accordance with claim 1, wherein the thickness of each of said thermoplastic, polyurethane sheets is in a range from about 0.003 mil to about 0.007 mil and the thickness of said nylon mesh sheets is about 0.001 mil.

3. A packaging component in accordance with claim 1, wherein the thickness of each of said thermoplastic, polyurethane films is about 0.003 mil and the thickness of said nylon mesh sheet is about 0.001 mil.

* * * * *